United States Patent [19]

Brisky

[11] Patent Number: 5,067,920

[45] Date of Patent: Nov. 26, 1991

[54] DIVE FLAG LINE DISPENSER APPARATUS

[76] Inventor: Michael J. Brisky, 9707 S. Gessner, Apt. #701, Houston, Tex. 77071

[21] Appl. No.: 668,232

[22] Filed: Mar. 12, 1991

[51] Int. Cl.[5] ..... B63B 21/52

[52] U.S. Cl. ..... 441/25; 441/26; 114/315

[58] Field of Search ..... 405/186; 114/312, 315, 114/336; 441/6, 21, 23–26

[56] References Cited

U.S. PATENT DOCUMENTS

| | | | |
|---|---|---|---|
| 1,588,798 | 6/1926 | Moore | 441/26 |
| 2,722,019 | 11/1955 | Brock | 441/26 |
| 2,830,307 | 4/1958 | Lawson | 441/25 |
| 2,957,446 | 10/1960 | Zasada | 441/26 |
| 3,005,215 | 10/1961 | Colt | 441/26 |
| 3,489,156 | 5/1963 | Haman | 441/25 |
| 4,014,478 | 3/1977 | Bonacina | 441/25 |
| 4,238,864 | 12/1980 | Kealoha | 441/25 |
| 4,246,671 | 1/1981 | Swenson | 441/25 |
| 4,781,636 | 11/1988 | Schurr | 441/26 |

*Primary Examiner*—Joseph F. Peters, Jr.
*Assistant Examiner*—Clifford T. Bartz
*Attorney, Agent, or Firm*—Leon Gilden

[57] ABSTRACT

A hand-held line and reeling structure is arranged in combination with a flotation buoy typically utilized in diving events. A tether line is secured to the dive buoy at one end and wound about a hand-held portable device to effect winding and reeling of the tether line to permit ease of return of a diver to the flotation buoy. The winding and reeling device further includes a separable cage member, including a spool formed with a triangular cross-sectional configuration groove to receive in a convenient and non-snap manner the tether line that is directed through a generally triangular opening formed within the cage head.

6 Claims, 4 Drawing Sheets

DIVE FLAG LINE DISPENSER APPARATUS

BACKGROUND OF THE INVENTION

1. Field of the Invention

The field of invention relates to diving apparatus, and more particularly pertains to a new and improved dive flag line dispenser apparatus wherein the same is arranged for underwater use in relation to a dive buoy as a reference point.

2. Description of the Prior Art

In diving events divers utilize a reference point, such as a flotation buoy on a water surface, to properly return divers to a point of origin relative to the water surface. Such buoys are frequently positioned by anchor lines, but not necessarily, and further, departure of divers relative to the anchor line and dive buoy present an important procedure in properly orienting a diver due to limitations of physical ability, available air, and the like.

Prior art diving apparatus may be found for example in U.S. Pat. No. 3,419,927 to Stoffer, et al. and U.S. Pat. No. 4,784,626 to Delaro wherein marker or located buoys are provided for attachment to a vessel and the like for indication of a diving or underwater reference.

Similarly, U.S. Pat. No. 4,004,310 to Faulstich, et al. and 4,717,092 to Cameron are further examples of marker buoy structures.

It may be appreciated therefore that the dive line dispenser apparatus of the instant invention attempts to overcome deficiencies of the prior art by providing the diver with a convenient and effective hand-held winding and reeling device associated with a marker buoy for effectively bracing and returning a diver relative to the marker buoy in a diving event and in this regard, the present invention substantially fulfills this need.

SUMMARY OF THE INVENTION

In view of the foregoing disadvantages inherent in the known types of diving apparatus now present in the prior art, the present invention provides a dive flag line dispenser apparatus wherein the same permits extension and retraction of a dive flag line relative to a marker buoy to permit ease of return of a diver to a marker buoy. As such, the general purpose of the present invention, which will be described subsequently in greater detail, is to provide a new and improved dive flag line dispenser apparatus which has all the advantages of the prior art diving apparatus and none of the disadvantages.

To attain this, the present invention provides a hand-held line and reeling structure arranged in combination with a flotation buoy typically utilized in diving events. A tether line is secured to the dive buoy at one end and wound about a hand-held portable device to effect winding and reeling of the tether line to permit ease of return of a diver to the flotation buoy. The winding and reeling device further includes a separable cage member, including a spool formed with a triangular cross-sectional configuration groove to receive in a convenient and non-snap manner the tether line that is directed through a generally triangular opening formed within the cage head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dive flag line dispenser apparatus which has all the advantages of the prior art diving apparatus and none of the disadvantages.

It is another object of the present invention to provide a new and improved dive flag line dispenser apparatus which may be easily and efficiently manufactured and marketed It is a further object of the present invention to provide a new and improved dive flag line dispenser apparatus which is of a durable and reliable construction.

An even further object of the present invention is to provide a new and improved dive flag line dispenser apparatus which is susceptible of a low cost of manufacture with regard to both materials and labor, and which accordingly is then susceptible of low prices of sale to the consuming public, thereby making such dive flag line dispenser apparatus economically available to the buying public.

Still yet another object of the present invention is to provide a new and improved dive flag line dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
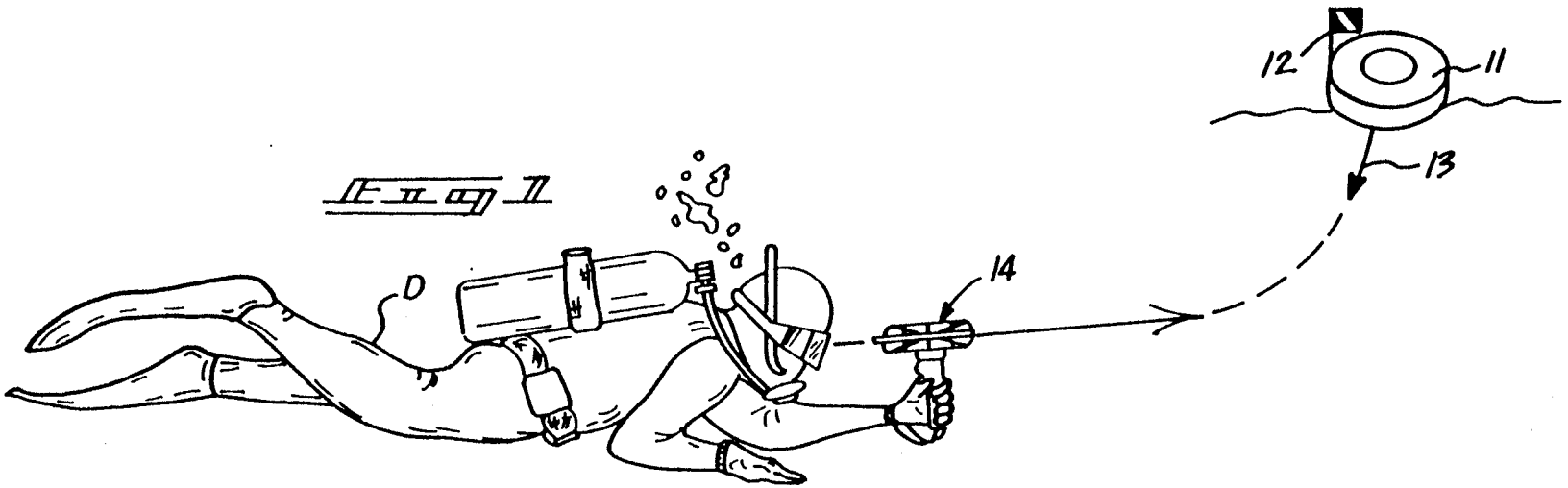
FIG. 1 is a side view of the organization of the instant invention utilized in a horizontal orientation.
Figure 2:
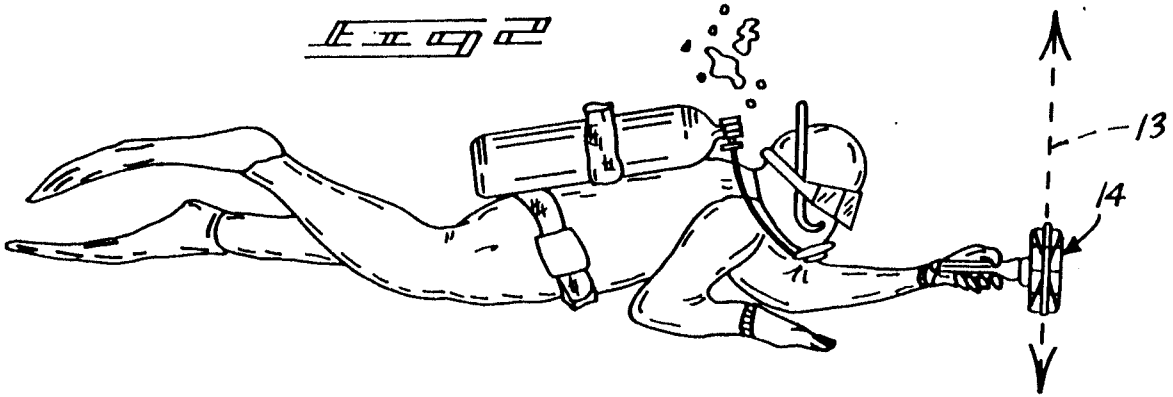
FIG. 2 is a side view of the organization utilized in a vertical orientation.
Figure 3:
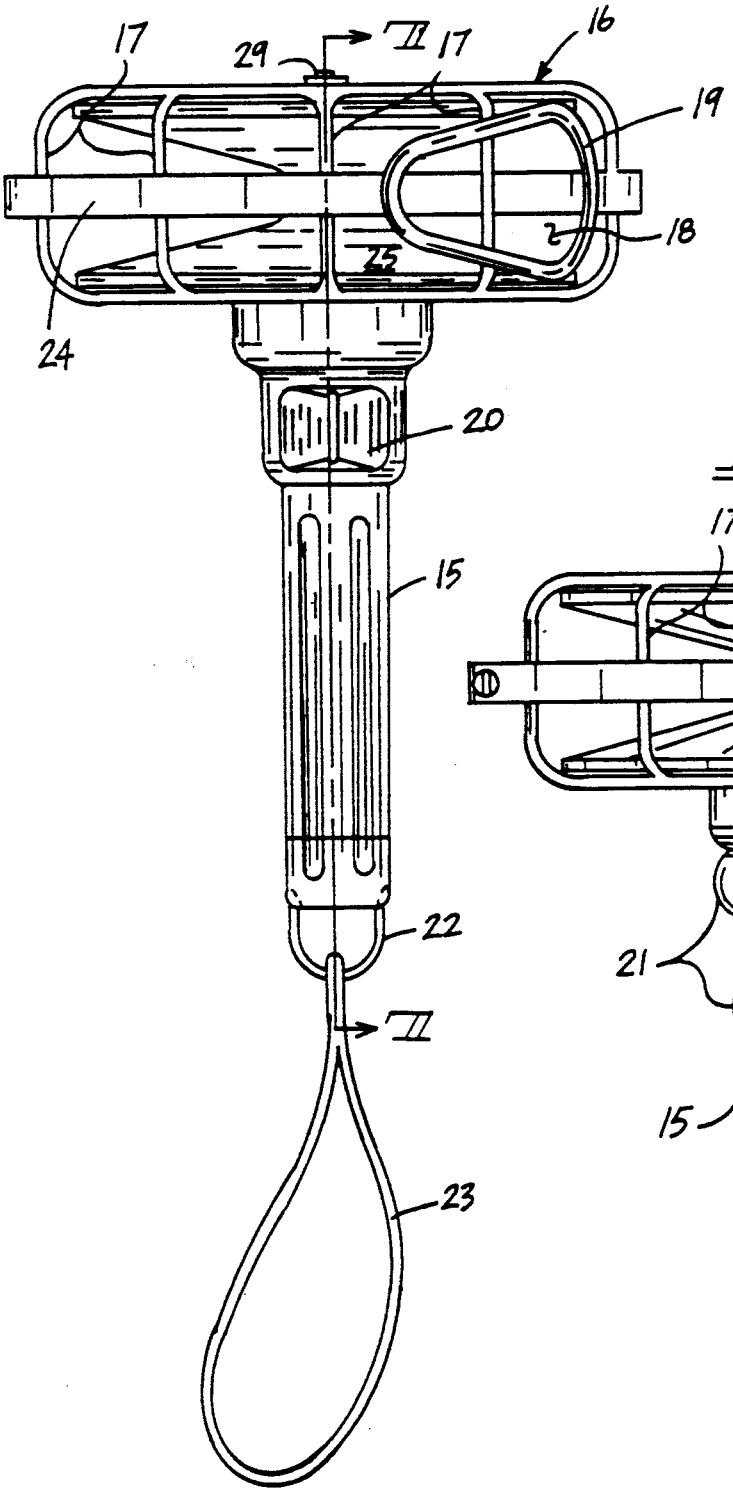
FIG. 3 is an orthographic side view of the dispenser unit utilized by the instant invention.
Figure 4:
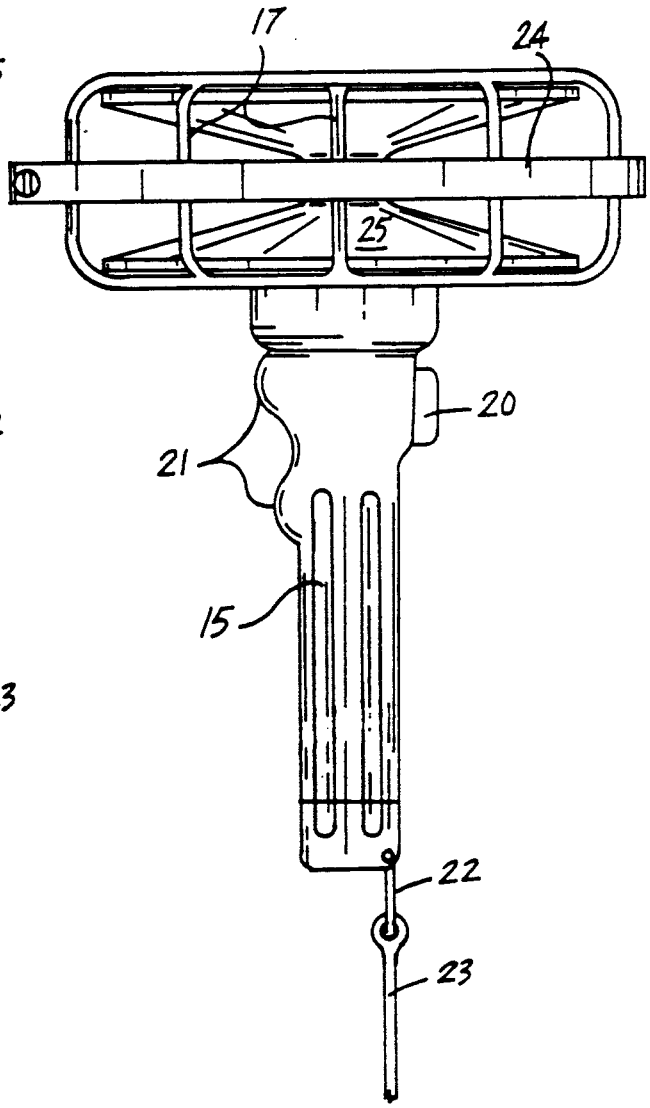
FIG. 4 is an orthographic side view of the dispenser unit of the instant invention rotated ninety degrees relative to FIG. 3.

With reference now to the drawings, and in particular to FIGS. 1 to 7 thereof, a new and improved dive flag line dispenser apparatus embodying the principles and concepts of the present invention and generally designated by the reference numeral 10 will be described.

More specifically, the dive flag line dispenser apparatus 10 of the instant invention essentially comprises the use of a flotation buoy 11 formed as a buoyant member, with a dive flag 12 mounted thereon to provide visible indication of a diving event in the immediate vicinity of the flotation of marker buoy 11. A flexible tether line 13 is mounted at its upper terminal end to the buoy 11, and at its lower terminal end about a dispenser unit 14.

The dispenser unit 14 includes a rigid, elongate handle 15, including a caged head 16 orthogonally mounted to an upper terminal end of the handle 15 The caged head 16 includes a circumferential series of equally spaced cage ribs 17 that are annularly arranged about an axis defined by the handle 15 and the caged head 16 mounted thereon. At least one triangular opening 18 is directed through the caged head 16 to provide access of the tether line 13 to a central rotatably spool 25 rotatably mounted and coaxially aligned relative to the handle 15 and caged head 16. The triangular opening 18 includes a frame member 19 formed thereabout defining a perimeter of the opening 18, with the frame member 19 defined by an arcuate cross-sectional configuration to minimize resistance and abrasion of the tether line 13 directed through the triangular opening 18. An on/off toggle switch 20 is mounted on the handle 15 adjacent the caged head 16 and is operative to affectively actuate in a counter or selective counter-clockwise manner the spool 18 by utilizing a through contact on/off switch 20 to permit rotation or counter-rotation of an associated drive motor 33 mounted within the handle 15 adjacent the caged head 16. The drive motor 33 includes a spool axle shaft 29 rotatably mounted to the motor 33 and fixedly mounted coaxially of the spool 25. Finger ribs 21 defining a central finger recess are mounted on the handle 15 diametrically opposed to the switch 20. A support ring 22 is mounted at a lower terminal end of the handle 15 mounting a flexible tether loop 23, wherein the tether loop is arranged for positioning about a diver's wrist, as illustrated by the diver "D" in FIG. 1 for example.

The caged head 16 includes a circumferential rib 24 that originates at a first side of a triangular opening 18 and is coextensively directed in a circumferential manner about the caged head 16 medially thereof and terminates at a second end of the triangular opening opposed to the first end. The circumferential rib 24 (see FIG. 6 for example) permits separation of the caged head 16 into an upper and lower head 30 and 31, as each of the cage ribs 17 are divided medially of their length to effect separation of the caged head 16 to permit access to the spool 25 for maintenance thereof. The spool 25 itself is defined by a conical upper spool surface and a conical lower spool surface 26 and 27 respectively to define a triangular spool cross-sectional support cavity 28 to provide a non-binding winding and reeling of the tether line 13 about the spool 25.

Figure 5:
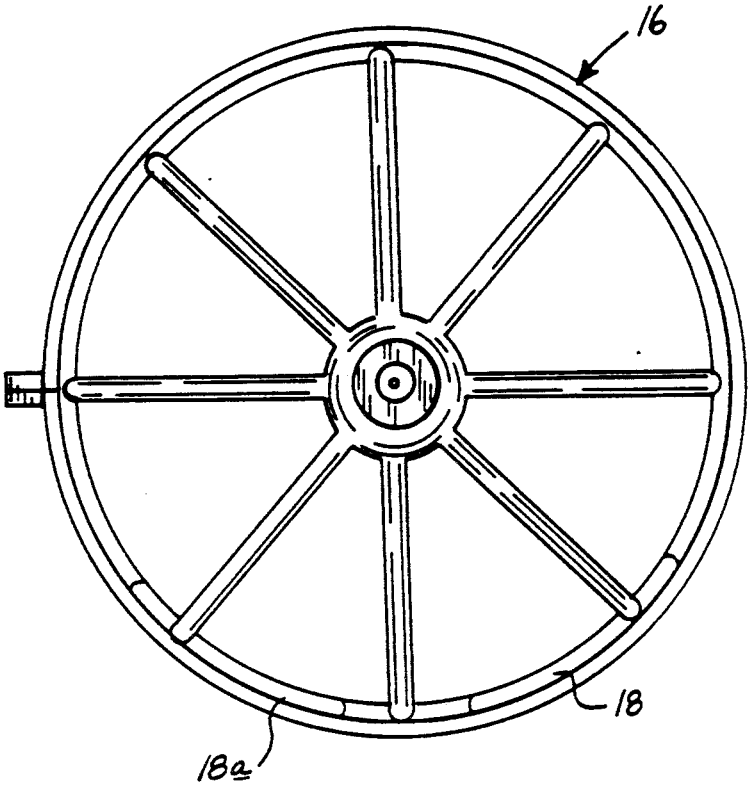
FIG. 5 is an orthographic top view of the cage structure utilized by the instant invention.
Figure 6:
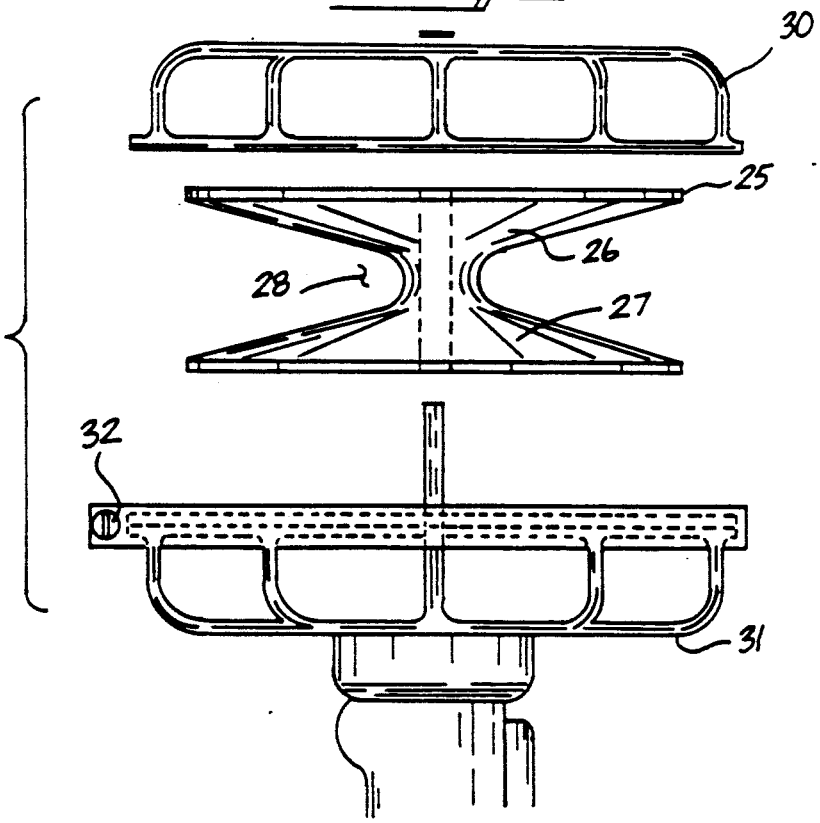
FIG. 6 is an orthographic exploded view of the cage structure of the instant invention.
Figure 7:
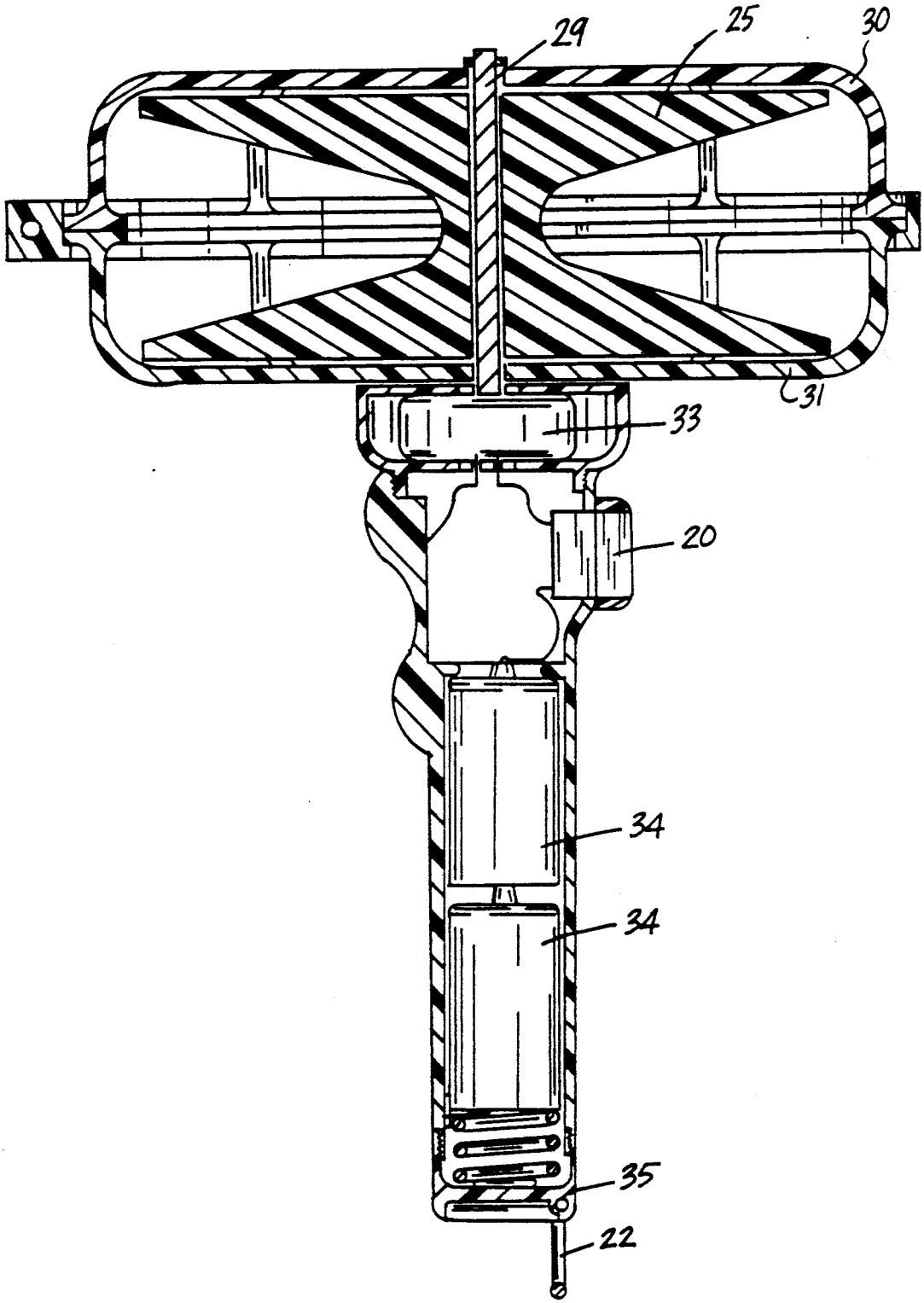
FIG. 7 is an orthographic cross-sectional illustration of the dispenser unit utilized by the instant invention.

It should be further noted that FIG. 5 illustrates the use of a second triangular opening 18*a* adjacent a first triangular opening directed through the caged head 16 to permit the tether line 13 to be exited simultaneously with entering the caged head where a tether line is anchored at a lowermost point and permit the tether line to be directed continuously through the caged head.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A dive flag line dispenser apparatus comprising, in combination, a flotation buoy arranged for flotation upon a top surface of a body of water, wherein the flotation buoy is formed of a buoyant material, and a flexible tether line, the flexible tether line including a forward terminal end mounted to the flotation buoy, and the flexible tether line including a rear terminal end, the rear terminal end rotatably secured within a dispenser unit, and the dispenser unit including a rigid, elongate handle, the handle fixedly mounting a caged head at an upper terminal of the handle, with the caged head coaxially aligned with the handle, and the caged head including a spool rotatably mounted within the caged head, wherein the spool is coaxially aligned relative to the handle, and motor means mounted within the handle to effect selective rotation and counter-rotation of the spool.

2. An apparatus as set forth in claim 1 wherein the caged head includes a plurality of vertical cage ribs equally spaced circumferentially about the caged head, wherein the cage ribs include at least one triangular opening directed therethrough, the triangular opening including a perimeter frame, wherein the perimeter frame is defined by an arcuate crosssectional configuration to non-abrasively direct the tether line therethrough to the spool.

3. An apparatus as set forth in claim 2 wherein each of the cage ribs are divided medially of their length to define a lower cage head fixedly mounted to the handle, and an upper cage head removably mounted relative to the lower cage head, and a circumferential clamping rib mounted to an upper terminal end of the lower cage head for selective securement of the upper cage head to the lower cage head, wherein the clamping rib extends from a first end of the triangular opening circumferentially about the lower cage head and is secured to a second end of the triangular opening spaced from the first end.

4. An apparatus as set forth in claim 3 wherein the motor means includes a motor mounted within an upper terminal end of the handle adjacent the caged head, and a switch member to effect selective rotation of the motor, and a plurality of finger ribs formed on the handle diametrically opposed to the switch, with the finger ribs defining a central finger recess therebetween to enhance manual securement of the handle, and a lower terminal end of the handle mounting a ring member, and the ring member including a flexible tether loop secured thereto for mounting about a wrist portion of a diver.

5. An apparatus as set forth in claim 4 wherein the spool includes conical upper spool surface and a conical lower spool surface defining a triangular spool cross-sectional support cavity therebetween to secure the tether line in a non-binding relationship.

6. An apparatus as set forth in claim 5 including a further triangular opening positioned adjacent the triangular opening directed through the caged head to permit a continuous relationship of the tether line through the caged head.

* * * * *